US009546620B2

(12) United States Patent
Pearce et al.

(10) Patent No.: US 9,546,620 B2
(45) Date of Patent: Jan. 17, 2017

(54) CANISTER DESIGN FOR EVAPORATIVE EMISSION CONTROL

(71) Applicant: Ford Global Technologies, LLC, Dearborn, MI (US)

(72) Inventors: Russell Randall Pearce, Ann Arbor, MI (US); Donald Ignasiak, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 382 days.

(21) Appl. No.: 14/341,623

(22) Filed: Jul. 25, 2014

(65) Prior Publication Data

US 2016/0025019 A1 Jan. 28, 2016

(51) Int. Cl.
*F02M 25/08* (2006.01)

(52) U.S. Cl.
CPC ..... *F02M 25/0854* (2013.01); *F02M 25/0836* (2013.01); *F02M 25/089* (2013.01)

(58) Field of Classification Search
CPC ..... F02M 25/0836; F02M 25/0854; F02M 25/0872; F02M 25/089
USPC ..... 123/516–521
See application file for complete search history.

(56) References Cited

U.S. PATENT DOCUMENTS 1,982,099 A * 11/1934 Hechenbleikner ..... B01D 46/32 422/218
3,815,335 A * 6/1974 Barnebey ..... B01D 53/025 55/474
4,673,420 A * 6/1987 Haker ..... B01D 53/261 55/484
5,697,348 A 12/1997 Schwager
6,695,896 B2 2/2004 Hara et al.
7,237,572 B2 7/2007 Haines et al.
7,323,041 B2 1/2008 Yoshida et al.
8,151,769 B2 4/2012 Lin et al.
8,617,299 B2 12/2013 Hasegawa et al.
8,647,418 B2 * 2/2014 Furuyama ..... B01D 53/06 96/131
2009/0013973 A1 * 1/2009 Yamasaki ..... F02M 25/0854 123/519
2013/0298879 A1 * 11/2013 Pearce ..... F02M 25/0836 123/520
2014/0123961 A1 5/2014 Kragh et al.
2014/0230796 A1 * 8/2014 Brock ..... F02M 25/0854 123/520

FOREIGN PATENT DOCUMENTS

DE 102011009149 A1 7/2012

* cited by examiner

*Primary Examiner* — Thomas Moulis
(74) *Attorney, Agent, or Firm* — James Dottavio; Alleman Hall McCoy Russell & Tuttle LLP

(57) ABSTRACT

Methods and systems are provided for purging a fuel vapor canister into an engine intake. A method comprises flowing fuel vapors from a fuel tank through a full length of the fuel vapor canister from a first input to a first output on a first opposite side from the first input. The adsorbed fuel vapors may be purged from the fuel vapor canister through a full width in the fuel vapor canister from a second input to a second output on a second opposite side from the second input.

19 Claims, 8 Drawing Sheets

CANISTER DESIGN FOR EVAPORATIVE EMISSION CONTROL

FIELD

The present invention relates to purging a fuel vapor canister coupled to a fuel system in a vehicle.

BACKGROUND AND SUMMARY

Vehicles may be fitted with evaporative emission control systems to reduce the release of fuel vapors to the atmosphere. For example, vaporized hydrocarbons (HCs) from a fuel tank may be stored in a fuel vapor canister packed with an adsorbent which adsorbs and stores the fuel vapors. At a later time, the evaporative emission control system may purge the stored fuel vapors from the fuel vapor canister into the engine intake. The fuel vapors may then be consumed during combustion.

During a canister purge operation, a canister purge valve coupled between the engine intake and the fuel vapor canister is opened, allowing for intake manifold vacuum to be applied to the fuel vapor canister. Simultaneously, a canister vent valve coupled between the fuel vapor canister and atmosphere is opened, allowing for fresh air to enter the canister. This configuration facilitates desorption of stored fuel vapors from the adsorbent in the canister, regenerating the adsorptive material for further fuel vapor adsorption.

However, hybrid vehicles and other low-manifold vacuum vehicles may have limited engine run-time with sufficient manifold vacuum to execute a purging operation. Herein, a duration of purge operation may not achieve adequate desorption of stored fuel vapors from the fuel vapor canister. As such, if the fuel vapor canister is not completely purged, exhaust hydrocarbons may slip into the atmosphere, degrading exhaust emissions and making the vehicle emissions non-compliant. In addition, the low vacuum may increase engine operation time in a hybrid vehicle in order to purge the fuel vapor canister. The unintended increase in engine run time for the hybrid vehicle can degrade vehicle fuel economy.

The inventors herein have recognized the above issues and have developed systems and methods to at least partially address them. In one example, a method may comprise flowing fuel vapors from a fuel tank through a full length of a fuel vapor canister from a first input to a first output on a first opposite side from the first input, and purging the fuel vapors from the fuel vapor canister through a full width in the fuel vapor canister from a second input to a second output on a second opposite side from the second input. In this way, a fuel system canister can be purged in a shorter duration since the flow directions of the purging and storing are oblique with respect to one another and of different effective lengths, in one example. Further, storage flow may be along only a single path without multiple internal blocking check valves in parallel, whereas purge flow may include a plurality of parallel flow paths via internal blocking check valves and apertures each positioned in parallel.

For example, a fuel vapor canister comprising adsorptive material may be fluidically coupled to a fuel tank via a first input. Fuel vapors received from the fuel tank may flow from the first input to a first output through an entire length of the fuel vapor canister. For example, the first output may be located directly opposite from the first input such that the entire length of the canister is encompassed between the first input and the first output. When purging conditions are met, a canister vent valve may be opened to enable atmospheric air to enter the canister through a second input and desorb stored fuel vapors from within the adsorbent in the canister. The atmospheric air may purge the desorbed fuel vapors through a full width of the fuel vapor canister by flowing from the second input to a second output. Herein, the second output of the canister may be positioned directly across from the second input such that the full width of the canister is encompassed between the second input and the second output. As such, the entire length of the canister may be greater than the full width of the canister. Thus, fuel vapors from the fuel tank may flow through a longer distance (entire length) for adsorption and desorbed fuel vapors may flow across a shorter distance (full width) during purging operation.

In this way, a canister may be quickly and sufficiently purged by reducing a length of purge flow. By flowing the fuel vapors through a longer portion of the adsorbent, a larger proportion of fuel vapors may be adsorbed within the canister. Further, as the adsorbed vapors are purged across a shorter width of the canister, fuel vapors may be expelled more rapidly from the canister, and a duration to purge the canister may be lowered. Furthermore, the likelihood of bleed emissions from the canister may be reduced by enabling a more complete purge of the canister. Overall, exhaust emissions and emissions compliance may be improved.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
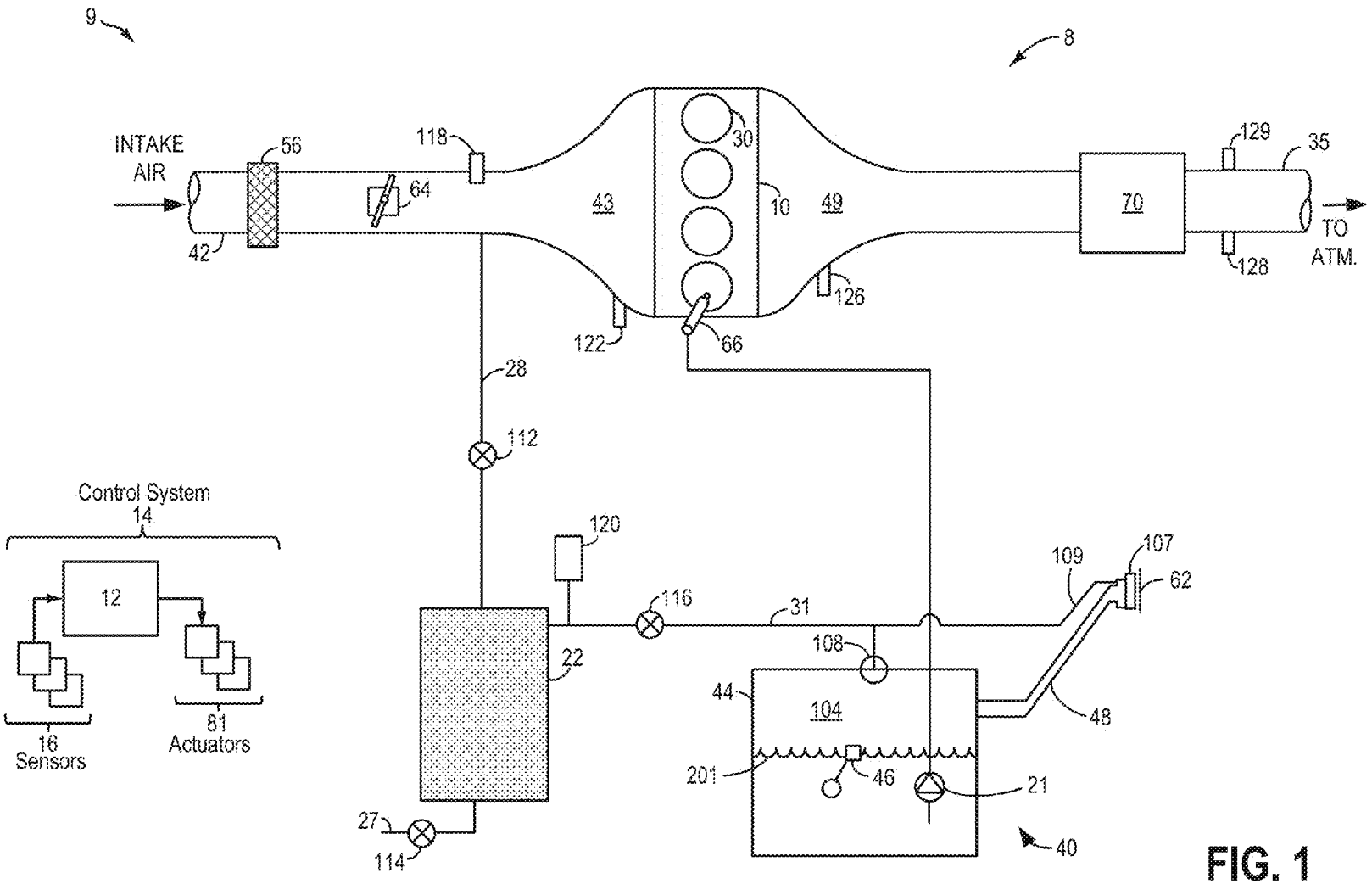
FIG. 1 schematically shows an example of an engine and an associated fuel system.
Figure 6:
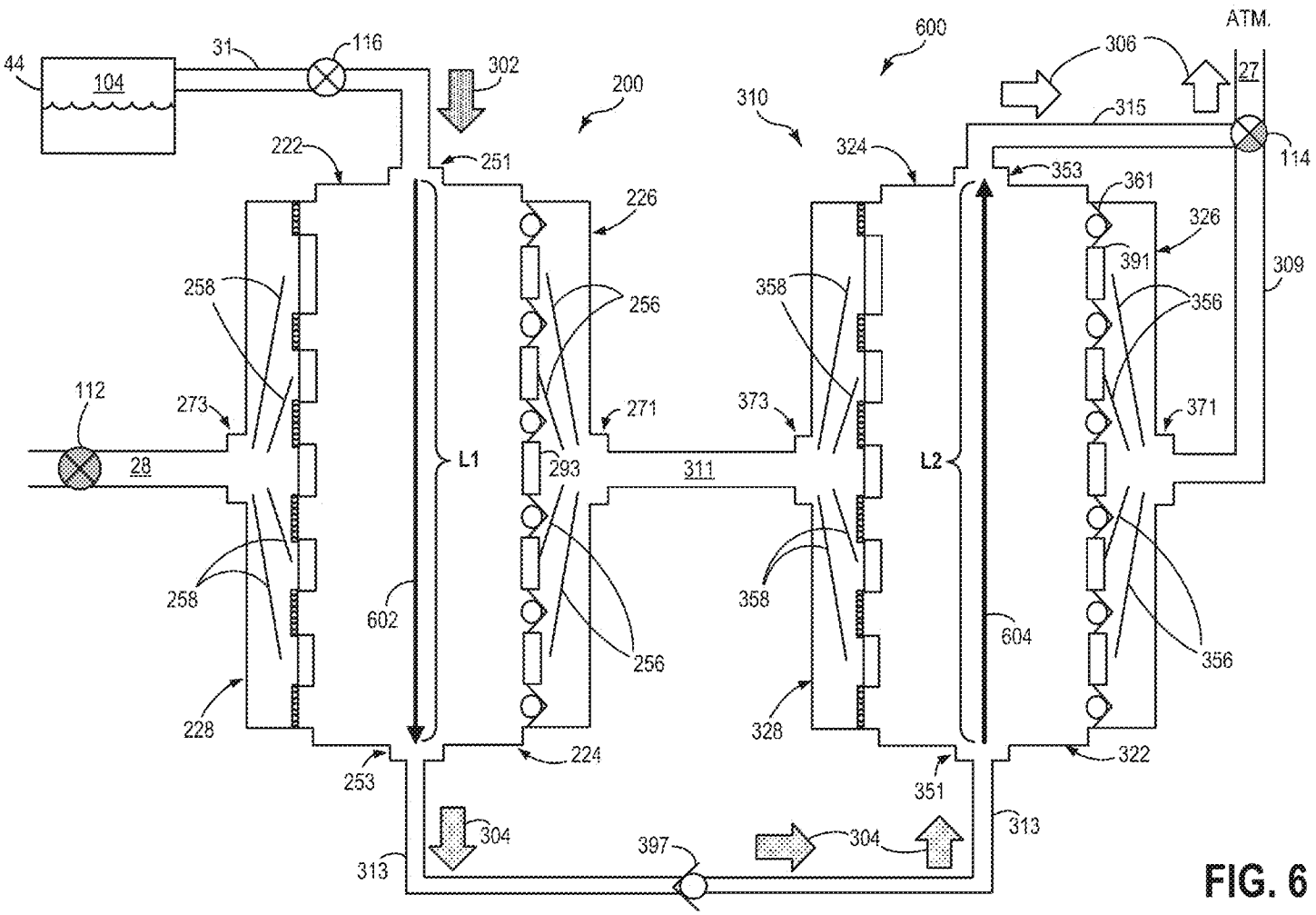
FIG. 6 shows fuel tank vapors being stored in the fuel vapor canisters of FIGS. 3-5 during refueling conditions.
Figure 7:
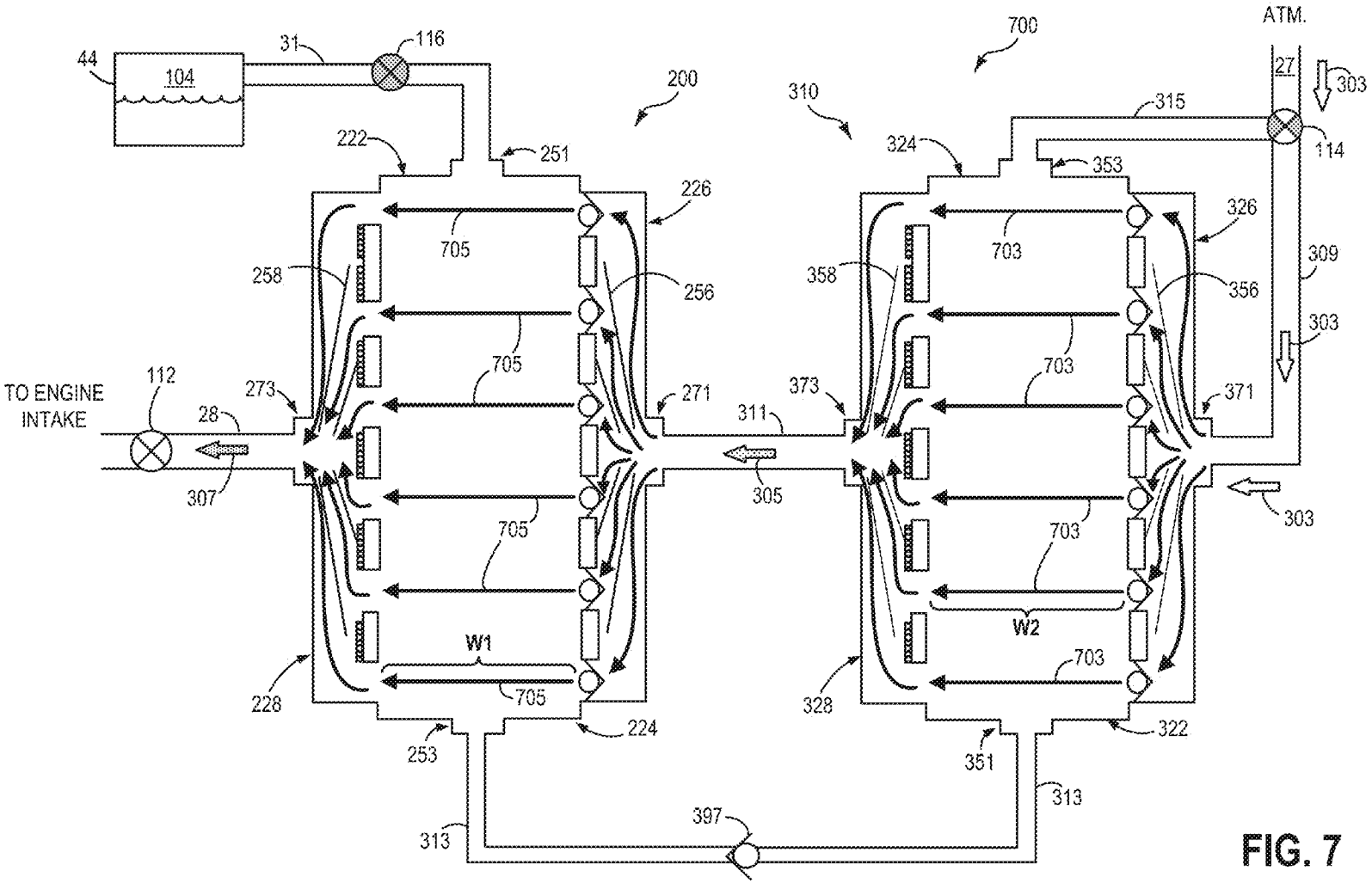
FIG. 7 shows fuel tank vapors being purged from the fuel vapor canisters of FIGS. 3-5 during purging conditions.

The present description relates to a fuel vapor canister design for controlling evaporative emissions in a vehicle with an engine and fuel system such as that shown in FIG. 1. More particularly, the present disclosure relates to the adsorption of fuel vapors, and subsequent purging of the fuel vapors from a canister of a vehicle fuel system, such as the canister of FIG. 2. The fuel system may include more than one canister. In the embodiments shown in FIGS. 3-5, two canisters are depicted fluidically coupled to each other. During refueling conditions, each of a vent valve and a purge valve of the canister (or group of canisters) may be closed to allow an entire length of the canister(s) to be loaded with fuel vapors from the fuel tank (FIG. 6). Then, during purging conditions, each of the vent valve and the purge valve of the canister (or group of canisters) may be opened to allow fresh air to enter the canister(s) and purge the fuel vapors across a width of the canister(s) (FIG. 7). Such an approach may enable faster canister purging in low vacuum air induction engine applications. Furthermore, such an approach may also be applicable to hybrid electric vehicle (HEV) applications and other applications with limited engine run time. A controller may be configured to perform a control routine, such as the example routine of FIG. 8, to adjust the position of different valves enabling adsorption and purging of fuel vapors.

FIG. 1 shows a schematic depiction of an engine system 8 coupled in a vehicle system 9. In one example, vehicle system 9 may be a hybrid vehicle system. Engine system 8 may include an engine 10 having a plurality of cylinders 30. The cylinders 30 may receive intake air from an intake manifold 43 via an intake passage 42 and may exhaust combustion gases to an exhaust manifold 49 and further to the atmosphere via exhaust passage 35. The intake air received in the intake passage 42 may be cleaned upon passage through an intake air cleaner 56.

The intake passage 42 may include a throttle 64. In this particular example, the position of the throttle 64 may be varied by a controller 12 via a signal provided to an electric motor or actuator included with the throttle 64, a configuration that is commonly referred to as electronic throttle control (ETC). In this manner, the throttle 64 may be operated to vary the intake air provided to the plurality of cylinders 30. The intake passage 42 may include a mass air flow sensor 118 and a manifold air pressure sensor 122 for providing respective signals MAF and MAP to the controller 12.

An emission control device 70 is shown arranged along the exhaust passage 35. The emission control device 70 may be a three way catalyst (TWC), NOx trap, various other emission control devices, or combinations thereof. In some embodiments, during operation of the engine 10, the emission control device 70 may be periodically reset by operating at least one cylinder of the engine within a particular air/fuel ratio. An exhaust gas sensor 126 is shown coupled to the exhaust manifold 49 upstream of the emission control device 70. The exhaust gas sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. It will be appreciated that the engine system 8 is shown in simplified form and may include other components.

A fuel injector 66 is shown coupled directly to the cylinder 30 for injecting fuel directly therein in proportion to a pulse width of a signal received from the controller 12. In this manner, the fuel injector 66 provides what is known as direct injection of fuel into the cylinder 30. The fuel injector may be mounted in the side of the combustion chamber or in the top of the combustion chamber, for example. Fuel may be delivered to the fuel injector 66 by a fuel system 40. In some embodiments, cylinder 30 may alternatively or additionally include a fuel injector arranged in intake manifold 43 in a configuration that provides what is known as port injection of fuel into the intake port upstream of the cylinder 30.

Engine system 8 is shown coupled to fuel system 40 which includes a fuel tank 44 coupled to a fuel pump 21 and a fuel vapor canister 22. Fuel tank 44 receives fuel via a refueling line 48, which acts as a passageway between the fuel tank 44 and a fuel door 62 on an outer body of the vehicle. During a fuel tank refueling event, fuel may be pumped into the vehicle from an external source through refueling inlet 107 which is normally covered by a gas cap. During a refueling event, while fuel is pumped into fuel tank 44, one or more fuel tank vent valves may be opened to allow refueling vapors to be directed to, and stored in, canister 22.

Fuel pump 21 is configured to pressurize fuel delivered to fuel injectors of engine 10, such as fuel injector 66. While only a single fuel injector 66 is shown, additional injectors are provided for each cylinder. It will be appreciated that fuel system 40 may be a return-less fuel system, a return fuel system, or various other types of fuel system.

Vapors generated in fuel tank 44 may be routed to fuel system canister 22, via conduit 31, before being purged to intake passage 42. Fuel tank 44 may include one or more fuel tank vent valves for venting diurnals and refueling vapors generated in the fuel tank to fuel system canister 22. The one or more vent valves may be electronically or mechanically actuated valves and may include active vent valves (that is, valves with moving parts that are actuated open or close by a controller) or passive valves (that is, valves with no moving parts that are actuated open or close passively based on a tank fill level). In the depicted example, fuel tank 44 includes a passive fuel level vent valve (FLVV) 108 that includes a float mechanism 46 which, when displaced by fuel, shuts off the vapor flow between the fuel tank and the canister. Thus, based on a fuel level 201 relative to vapor space 104 in the fuel tank, the vent valve may be open or closed. For example, FLVV 108 may be normally open allowing fuel tank overfilling to be prevented. During fuel tank refilling, when a fuel level 201 is raised, FLVV 108 may close, causing pressure to build in vapor line 109 (which is downstream of refueling inlet 107 and coupled thereon to conduit 31) as well as at a filler nozzle coupled to the fuel pump. The increase in pressure at the filler nozzle may then trip the refueling pump, stopping the fuel fill process automatically, and preventing overfilling.

Fuel system canister 22 is filled with an appropriate adsorbent for temporarily trapping fuel vapors (including vaporized hydrocarbons) generated during fuel tank refueling operations, as well as diurnal vapors. In one example, the adsorbent used is activated charcoal. When purging conditions are met, such as when the canister is saturated, vapors stored in fuel vapor canister 22 may be purged to intake passage 42, downstream of throttle 64, via purge line 28 by opening canister purge valve 112. While a single fuel vapor canister 22 is shown in FIG. 1, it will be appreciated that fuel system 40 may include any number of canisters.

In embodiments where engine system 8 is coupled in a hybrid vehicle system, the engine may have reduced operation times due to the vehicle being powered by engine system 8 during some conditions, and by a system energy storage device under other conditions. While the reduced engine operation times reduce overall carbon emissions from the vehicle, they may also lead to insufficient purging of fuel vapors from the vehicle's emission control system. To address this, in some embodiments, a fuel tank isolation valve (FTIV) 116 may be optionally included in conduit 31 such that fuel tank 44 is coupled to canister 22 via FTIV 116. When included, the isolation valve may be kept closed during engine operation so as to limit the amount of diurnal vapors directed to canister 22 from fuel tank 44. During refueling operations, and selected purging conditions, the isolation valve may be temporarily opened e.g., for a duration, to direct fuel vapors from the fuel tank 44 to canister 22. By opening the valve when the fuel tank pressure is higher than a threshold (e.g., above a mechanical pressure limit of the fuel tank above which the fuel tank and other fuel system components may incur mechanical damage), the fuel tank vapors may be released into the canister and the fuel tank pressure may be maintained below pressure limits.

The fuel vapor canister 22 may be fluidically coupled to a vent line 27 for routing gases out of the canister 22 to the atmosphere when storing, or trapping, fuel vapors from fuel tank 44 (also termed, refueling flow). Vent line 27 may also allow fresh air to be drawn into fuel vapor canister 22 when purging stored fuel vapors to intake passage 42 via purge line 28 and canister purge valve 112. Flow through vent line 27 may be controlled by a canister vent valve 114 to adjust a flow of air and vapors between canister 22 and the atmosphere. In one example, canister vent valve 114 may be a three-way valve capable of switching between storage (or refueling) flow and purge flow. For example, the canister vent valve 114 may be switched to a first position during fuel vapor storing operations (for example, during fuel tank refueling and while the engine is not running) so that air, stripped of fuel vapors after having passed through the canister, can be pushed out to the atmosphere. Likewise, during purging operations (for example, during canister regeneration and while the engine is running), the canister vent valve 114 may be switched to a second position to allow a flow of fresh air to strip the fuel vapors stored in the canister. By closing canister vent valve 114, the fuel tank may be isolated from the atmosphere. While this example shows vent line 27 communicating with fresh, unheated air, various modifications may also be used. The canister vent valve 114 may also be used for diagnostic routines.

One or more pressure sensors 120 may be coupled to fuel system 40 for providing an estimate of a fuel system pressure. In one example, the fuel system pressure is a fuel tank pressure, wherein pressure sensor 120 is a fuel tank pressure sensor (or fuel tank pressure transducer FTPT) coupled to fuel tank 44 for estimating a fuel tank pressure or vacuum level. While the depicted example shows pressure sensor 120 coupled between fuel tank 44 and canister 22, in alternate embodiments, the pressure sensor may be directly coupled to fuel tank 44.

Fuel vapors released from canister 22 during a purging operation may be directed into the engine intake downstream of throttle 64 via purge line 28. The flow of vapors along purge line 28 may be regulated by canister purge valve 112, coupled between the fuel vapor canister 22 and the engine intake passage 42. The quantity and rate of vapors released by the canister purge valve 112 may be determined by the duty cycle of an associated canister purge valve solenoid (not shown). As such, the duty cycle of the canister purge valve solenoid may be determined by the vehicle's powertrain control module (PCM), such as controller 12, responsive to engine operating conditions, including, for example, engine speed-load conditions, an air-fuel ratio, a canister load, etc. Controller 12 may thus regulate flow from the fuel vapor canister 22 to the intake passage 42 while canister vent valve 114 positioned in the vent line 27 may be controlled by the controller 12 to regulate the flow of air and vapors between the fuel vapor canister 22 and the atmosphere. By commanding the canister purge valve 112 to be closed, the controller may seal the fuel vapor recovery system from the engine intake.

An estimate of the mass airflow (MAF) may be obtained from MAF sensor 118 coupled to intake passage 42, and communicated with controller 12. Alternatively, MAF may be inferred from alternate engine operating conditions, such as manifold pressure (MAP), as measured by a MAP sensor 122 coupled to the intake manifold. During purging operation, a purge air mass may be measured by the engine MAF sensor 118 or referenced from calibrated inferred purge air mass table values. If not measured by the MAF sensor, purge air mass from the atmosphere entering the canister may be inferred from bench flow data populated in PCM strategy purge air mass tables. Hydrocarbon or oxygen sensor outputs may be used to determine a purge air hydrocarbon concentration which is then controlled using engine air-to-fuel ratio feedback PCM algorithms. In alternate embodiments, an inline sensor and a feed-forward strategy may be used to measure the hydrocarbon concentration of the purge air. The in-line sensor may be located in intake manifold 43. Alternatively, the in-line sensor may be configured to sense the hydrocarbon concentration in the incoming purge air received within the purge line 28. In response to receiving purge vapors into the intake passage 42, an air/fuel ratio may be modified by controller 12.

Fuel system 40 may be operated by controller 12 in a plurality of modes by selective adjustment of the various valves and solenoids. For example, the fuel system may be operated in a fuel vapor storage mode wherein the controller 12 may close canister purge valve (CPV) 112 and open canister vent valve (CVV) 114 and fuel tank isolation valve (FTIV) 116 to direct refueling and diurnal vapors into canister 22 while preventing fuel vapors from being directed into the intake manifold.

As another example, the fuel system may be operated in a canister purging mode (e.g., after an emission control device light-off temperature has been attained and with the engine running), wherein the controller 12 may open CPV 112, CVV 114, and close FTIV 116. By closing the FTIV, the canister can be purged more efficiently during the limited engine-on time that is available in a hybrid vehicle. During the canister purging mode, vacuum generated by the intake manifold of the operating engine may be used to draw fresh air through vent line 27 and through fuel system canister 22 to purge the stored fuel vapors into intake passage 42. In this mode, the purged fuel vapors from the canister are combusted in the engine. The purging may be continued until the stored fuel vapors amount in the canister is below a threshold or until the engine is deactivated and an electric mode of vehicle operation is resumed.

During purging, the learned vapor amount/concentration can be used to determine the amount of fuel vapors stored in the canister, and then during a later portion of the purging operation (when the canister is sufficiently purged or empty), the learned vapor amount/concentration can be used to estimate a loading state of the fuel system canister. In another embodiment, at an appropriate time after key off, a controller may "wake up" and determine the current load present in a fuel system canister based on inputs from sensors. For example, one or more oxygen sensors (not shown) may be coupled to the canister 22 (e.g., downstream of the canister), or positioned in the engine intake and/or engine exhaust, to provide an estimate of a canister load (that is, an amount of fuel vapors stored in the canister). In another example, the fuel system canister load may be based on the number and duration of refueling events that have occurred following a previous canister purging event.

Vehicle system 9 may further include control system 14. Control system 14 is shown receiving information from a plurality of sensors 16 (various examples of which are described herein) and sending control signals to a plurality of actuators 81 (various examples of which are described herein). As one example, sensors 16 may include exhaust gas (air/fuel ratio) sensor 126 located upstream of the emission control device, exhaust temperature sensor 128, MAF sensor 118, and exhaust pressure sensor 129. Other sensors such as additional pressure, temperature, air/fuel ratio, and composition sensors may be coupled to various locations in the vehicle system 9. As another example, the actuators may include fuel injector 66, CPV 112, CVV 114, FTIV 116, and throttle 64. The control system 14 may include a controller 12. The controller may receive input data from the various sensors, process the input data, and trigger the actuators in response to the processed input data based on instruction or code programmed therein corresponding to one or more routines. An example control routine will be described with regard to FIG. 8.

Figure 2:
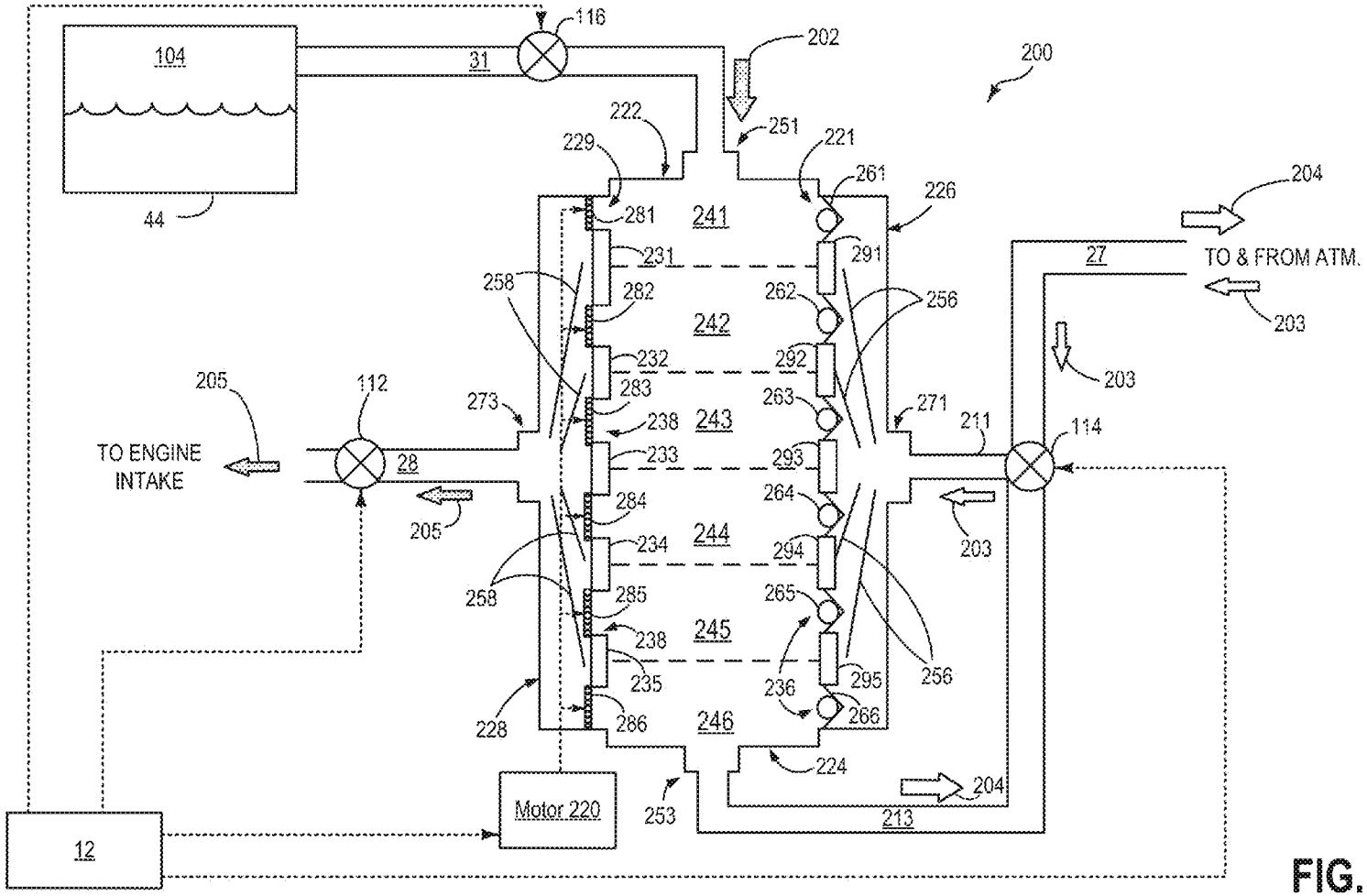
FIG. 2 schematically depicts an embodiment of a fuel vapor canister, according to the present disclosure, coupled in the fuel system of FIG. 1.

FIG. 2 schematically shows a first example embodiment of a fuel vapor canister 200 according to an embodiment of the present disclosure. In one example, the canister 200 may be implemented in the engine system 8 and fuel system 40 shown in FIG. 1. It will be appreciated that engine system components introduced in FIG. 1 are numbered similarly and not reintroduced. Likewise, canister components introduced in FIG. 2 are numbered similarly in FIGS. 3-7 and not reintroduced.

The canister 200 includes a first input (or tank port) 251 fluidically coupled with fuel tank 44 via conduit 31. The tank port 251 is a canister inlet that permits fuel vapors that escape from the fuel tank to enter the canister 200 for storage when fuel tank isolation valve (FTIV) 116 is opened. In one example, the canister 200 is filled with adsorptive material such as activated charcoal to store the received fuel vapors. Adsorptive material in canister 200 is indicated as regions 241-246, which will be further described below. Tank port (or first input) 251 is positioned on a first side 222 of canister 200. Vapors exiting fuel tank 44 may enter first input 251 along with air from vapor space 104. The mixture of air and fuel vapors entering first input 251 is shown as arrow 202.

Canister 200 also includes a first output (or an exit port) 253 arranged on second side 224. As depicted in FIG. 2, first output 253 is positioned directly across from first input 251 on a first opposite side 224 from first input 251. In other words, first side 222 and second side 224 are arranged opposite each other, and second side 224 may be a first opposite side to first input 251. Upon entering canister 200, the mixture of air and fuel vapors 202 may flow through the full length of canister 200 from first input 251 to first output 253. Along the way, fuel vapors may be adsorbed within the adsorptive material (in regions 241-246) and primarily air, with few traces of fuel, may exit canister 200 via first output 253 as arrow 204.

First output 253 may be fluidically coupled to canister vent valve (CVV) 114 via conduit 213 and therefrom, to the atmosphere via vent line 27. As mentioned earlier in reference to FIG. 1, CVV 114 may be a three-way valve that can be switched between fluidically coupling conduit 213 (and first output 253) to the atmosphere via vent line 27 at a first position to fluidically coupling a second input 271 of canister 200 and conduit 211 to the atmosphere via vent line 27 at a second position. When in the first position, e.g. during the refueling or storage flow, CVV 114 may allow air (arrow 204) to exit canister 200 via conduit 213 and be released into the atmosphere via vent line 27. In this position, second input 271 may not be fluidically coupled to the atmosphere and may be blocked from communicating with the atmosphere. Further, when CVV 114 is in the second position, e.g. during purging, air from the atmosphere (arrow 203) may enter canister 200 via vent line 27, past CVV 114, through conduit 211, and into second input 271. With the CVV 114 in its second position, first output 253 and conduit 213 may not be fluidically coupled to the atmosphere and may be blocked from communication with the atmosphere. Second input 271 is shown arranged on third side 226 of canister 200. As depicted in FIG. 2, third side 226 adjoins first side 222 and second side 224.

Adsorptive material within canister 200 may include a plurality of parallel regions 241, 242, 243, 244, 245, and 246 that may store fuel vapors. The regions may not be physically separated from each other and may be one contiguous region. The dotted lines depicted as borders between the regions 241-246 are merely for reference and are not present within the adsorbent.

As illustrated in the embodiment of FIG. 2, each region within the adsorbent may be bordered by two openings controlled on a first edge 221 by a check valve and on a second edge 229 by a sliding door or shutter. For example, region 245 has a first opening 236 controlled by check valve 265, and a second opening 238 controlled by sliding door 285. Though not specifically labeled in FIG. 2, each region has a similar first opening 236 and a second opening 238. For example, region 241 is shown flanked on first edge 221 by check valve 261 controlling its first opening 236. Region 241 is lined on second edge 229 by sliding door 281 controlling second opening 238. Likewise, region 242 is flanked on first edge 221 by check valve 262 and lined on second edge 229 by sliding door 282. Thus, regions 243, 244, 245, and 246 are similarly bordered on first edge 221 by respective check valves 263, 264, 265, and 266, and lined on second edge 229 by respective sliding doors 283, 284, 285, and 286. Accordingly, adsorptive material within canister 200 (as marked by regions 241, 242, 243, 244, 245, and 246) has a first plurality of openings 236 controlled by a plurality of check valves (261, 262, 263, 264, 265, and 266) and a second plurality of openings 238 regulated by a plurality of sliding doors (281, 282, 283, 284, 285, and 286).

Air flow into adsorptive material in regions 241, 242, 243, 244, 245, and 246 may be prevented by blocks 291, 292, 293, 294, and 295 on first edge 221, and air flow out of adsorptive material may be impeded on second edge 229 by blocks 231, 232, 233, 234, and 235. Further, as will be observed in FIG. 2, each block may adjoin two openings and respective check valves or sliding doors. For example, block 291 is shown bordering check valves 261 and 262. Similarly, block 234 is coupled to sliding door 284 and sliding door 285. The plurality of blocks ensure that entry into and exit out of the adsorptive material occurs solely through the plurality of check valves and plurality of sliding doors, respectively.

The plurality of check valves and sliding doors may control air flow into and out of the adsorptive material respectively. For example, the check valves ensure that air flow is unidirectional, e.g. air (or an air-fuel mixture) is permitted to flow into the adsorbent from second input 271 but reverse flow, as in air flowing out of adsorbent towards second input 271, is prevented. The plurality of sliding doors (also termed, sliding shutters) may be electrically coupled to and operated by motor 220. Controller 12 may actuate motor 220 during a purge operation to concurrently activate and open the plurality of sliding doors 281, 282, 283, 284, 285, and 286. Consequently, the sliding doors may be simultaneously moved to allow a purge flow of air and fuel vapors to exit the adsorbent towards CPV 112. For example, when actuated by motor 220, sliding door 286 may be moved to rest along block 235, thus unblocking one of second plurality of openings 238 and allowing desorbed fuel vapors to exit adsorptive material in region 246 past sliding door 286.

As depicted in the example of canister 200, sliding doors 281, 282, 283, 284, 285, and 286 may be positioned directly across and opposite respective check valves 261, 262, 263, 264, 265, and 266 controlling the first plurality of openings 236. Specifically, sliding door 281 is located directly opposite check valve 261. Similarly, check valve 266 is positioned directly across from sliding door 286. It will be appreciated that the adsorptive material between a check valve and a corresponding sliding door may be contiguous and may not include any barriers that obstruct air flow directly from the check valves on first edge 221 to the sliding doors on second edge 229. In another embodiment, the plurality of sliding doors may not be positioned directly across from the respective check valves. For example, the positions of the sliding doors may be staggered relative to the positions of the check valves. To elaborate, sliding door 282 may continue to be located on second edge 229 of adsorptive material opposite first edge 221 of adsorbent, across from check valve 262, but may be arranged at the position of block 232. At the same time, block 232 may be moved downwards to occupy the spot of sliding door 283. Similar shifts may be made to remaining sliding doors and blocks along second edge 229 to achieve a staggered arrangement between the plurality of sliding doors and plurality of check valves. In yet another embodiment, check valves 261, 262, 263, 264, 265, and 266 may not be arranged in a parallel manner as depicted in FIG. 2. The check valves may be spread out, for example, in a maze form, or arranged in an alternating manner.

As such, each pair of check valve and sliding door may be positioned such that during purging of the corresponding region, a substantial portion of air flows past the check valve, through the corresponding region to the corresponding sliding door. In this way, a shorter, direct air flow may occur across the width of canister 200. A smaller portion of air may not follow the same direct path past a check valve to a corresponding sliding door. For example, a larger proportion of air may enter region 244 via corresponding check valve 264 and a smaller proportion of air may enter region 244 via check valve 262. The larger proportion of air entering region 244 via check valve 264 may exit the adsorptive material past sliding door 284. A smaller proportion of air may exit region 244 past sliding door 286 as it is actuated open by motor 220. Air flowing into canister (arrow 203) 200 via second input 271 may enter adsorptive material within the canister simultaneously through the multiple check valves located at first edge 221 of adsorptive material. Similarly, air and fuel vapors exiting adsorptive material in regions 241-246 (arrow 205) may flow past the plurality of sliding doors 281-286 simultaneously. As such, purge flow restriction reductions may be achieved by using simultaneous entry into and exit out of the adsorbent.

Canister 200 may also include multiple baffles 256 between second input 271 and first edge 221 of adsorptive material. Baffles 256 may guide air flow towards the plurality of check valves along first edge 221. Similarly, baffles 258 may be arranged, as shown in FIG. 2, between the plurality of sliding doors 281-286 and second output (or purge port) 273 to direct flow of desorbed vapors towards second output 273.

Second output (or outlet) 273 is shown positioned on fourth side 228 and may be fluidically coupled via purge line 28 and CPV 112 to the intake passage 42. Second output 273 is positioned on a second opposite side, or fourth side, 228 directly across from second input 271. Thus, second opposite side 228 differs from first opposite side 224. Specifically, first opposite side 224 is located directly across from first side 222, and second opposite side 228 is positioned directly across from second input 273 and third side 226.

In the view shown in FIG. 2, canister 200 may include first side 222, second side 224, third side 226, and fourth side 228. First side 222 and second side 224 are positioned directly across from and opposite each other. Further, a full length of the canister 200 (and adsorbent) may be included therebetween. In other words, the full length of canister 200 may be included between first side 222 and second side 224. Furthermore, since first input 251 is positioned on first side 222 and first output is located on second side 224 (or first opposite side 224), the entire length of the canister may be included between first input 251 and first output 253. Similarly, third side 226 and fourth side 228 are arranged directly across from each other, and may include a full width of the canister therebetween. The full width of canister 200 may be included between third side 226 and fourth side 228. Further still, since second input 271 is positioned on third side 226 and second output 273 is arranged on fourth side 228 (also termed, second opposite side 228), the full width of canister may be included between the second input 271 and second output 273.

It will be appreciated that the entire length of the canister 200, as depicted in FIG. 2, between first side 222 and second side 224 is greater than the full width of the canister as encompassed between third side 226 and fourth side 228. Further, it will be noted that the first side 222, second side 224, third side 226, and fourth side 228 are distinct from one another and mutually exclusive of each other.

It will also be appreciated that the view of canister 200 shown in FIG. 2 is a section through an embodiment of a canister according to the present disclosure. The canister, in one example, may have a square cross-section. In other examples, other shapes are possible. In the depicted view of FIG. 2, adsorptive material is shown flanked by a first set of openings (and check valves) on first edge 221 and a second set of openings (and sliding doors) on second edge 229. It will be further appreciated that in an actual canister, the three-dimensional adsorptive material may be flanked on first edge 221 by multiple check valves arranged in multiple levels into the depth of the page (or in a direction towards the reader). Likewise, on second edge 229, adsorptive material may be lined by multiple sets of sliding doors arranged in multiple levels into the depth of the page (or in a direction towards the reader). In the depicted view of FIG. 2, adsorptive material as indicated by regions 241, 242, 243, 244, 245, and 246 may be surrounded by first side 222, second side 224, first edge 221, and second edge 229. More specifically, the adsorbent as shown in canister 200 may be enclosed by first side 222, second side 224, a plurality of check valves 261-266 and a plurality of blocks 291-295 along first edge 221, and a plurality of sliding doors 281-286 and a plurality of blocks 231-235 along second edge 229. Alternative embodiments may include an air space between first side 222 and adsorbent, and a distinct air space between second side 224 and adsorbent.

The plurality of regions within adsorbent including regions 241, 242, 243, 244, 245, and 246 may be simultaneously purged according to a fuel purging method discussed in further detail below.

During fuel tank refueling conditions, the CVV 114 may be actuated by controller 12 to the first position such that first output 253 is fluidically communicating with the atmosphere via conduit 213 and vent line 27. Further, FTIV 116 may be opened and CPV 112 may be maintained closed. Fuel tank vapors entering tank port (or first input) 251 can be vented to the atmosphere via vent line 27 only after flowing through the entire length of canister adsorbent (e.g., carbon) and exiting canister 200 via first output 253 (as shown by arrow 204). By flowing fuel tank vapors along the fullest extent of the length of the canister, a duration of adsorption may be increased. By increasing the residence time of the fuel vapors in the canister, adsorption efficiency may be enhanced.

During purge conditions, the FTIV 116 may be closed preventing the flow of fuel vapors from the tank into canister 200. Further, CVV 114 may be actuated by controller 12 to the second position such that second input 271 is fluidically communicating with the atmosphere via conduit 211 and vent line 27. Furthermore, the plurality of sliding doors along second edge 229 of adsorptive material may be actuated open by controller 12 via motor 220. Additionally, CPV 112 may be opened to fluidically couple second output 273 to intake passage 42 via purge line 28. Consequently, air (depicted by arrow 203) may be drawn into canister 200 via conduit 211 and vent line 27 due to intake manifold vacuum. Atmospheric air may flow into canister 200 through second input 271 and may be simultaneously guided by baffles 256 through the plurality of check valves 261, 261, 263, 264, 265, and 266 along first edge 221 of adsorptive material. The air may be streamed through the plurality of regions of adsorbent including regions 241, 242, 243, 244, 245, and 246 enabling desorption and purging of desorbed fuel vapors. Eventually, a mixture of air and desorbed fuel vapors may concurrently exit the adsorbent past the plurality of sliding doors 281, 282, 283, 284, 285, and 286. The mixture (depicted as arrow 205) may be directed by baffles 258 towards second output 273, and thereon into purge line 28. Further, the mixture may flow across CPV 112 through purge line 28 into the intake passage 42 downstream of throttle 64, so that the desorbed fuel vapors can be consumed by combustion instead of being vented to the atmosphere.

Therefore, in the embodiment depicted in FIG. 2, refueling or storage flow of fuel vapors from the fuel tank may follow a longer adsorptive path along the full length of the canister while purge flow may occur along a shorter path substantially along the width of the canister. Further, the purging of fuel vapors across the width of the canister may occur in a substantially perpendicular direction to the storage flow of fuel tank vapors through the full length of the canister. The longer adsorptive flow may support greater adsorption of fuel vapors reducing bleed emissions. The shorter purge path may facilitate a faster and more complete purging of fuel vapors from different regions of the canister. Since each region of adsorptive material (e.g., 241, 242, etc.) is purged via air flowing through its respective check valve and sliding door, the amount of time it takes to purge each region may be similar or substantially the same. It will be appreciated that the canister may include any suitable number of check valves and sliding doors regulating the flow of air through adsorbent regions that may be located in any suitable position on the canister without departing from the scope of the present disclosure.

In this way, an adsorptive flow of fuel vapors from a fuel tank may be directed through a length of a fuel vapor canister from a first side (222) to a second, opposite, side (224) of the fuel vapor canister, and a purge flow of fuel vapors from the fuel vapor canister to an engine intake may be streamed across a width in the fuel vapor canister from a third side (226) to a fourth side (228) of the fuel vapor canister. Further, a length of adsorptive flow through the length of the fuel vapor canister is greater than a length of the purge flow across the width of the fuel vapor canister. The purge flow may include flowing air concurrently through a plurality of openings controlled by a plurality of check valves into an adsorptive material within the fuel vapor canister, each opening controlled by a respective check valve. Additionally, the purge flow may exit the adsorptive material via a plurality of sliding doors, the plurality of sliding doors positioned directly across from the plurality of check valves.

Figure 3:
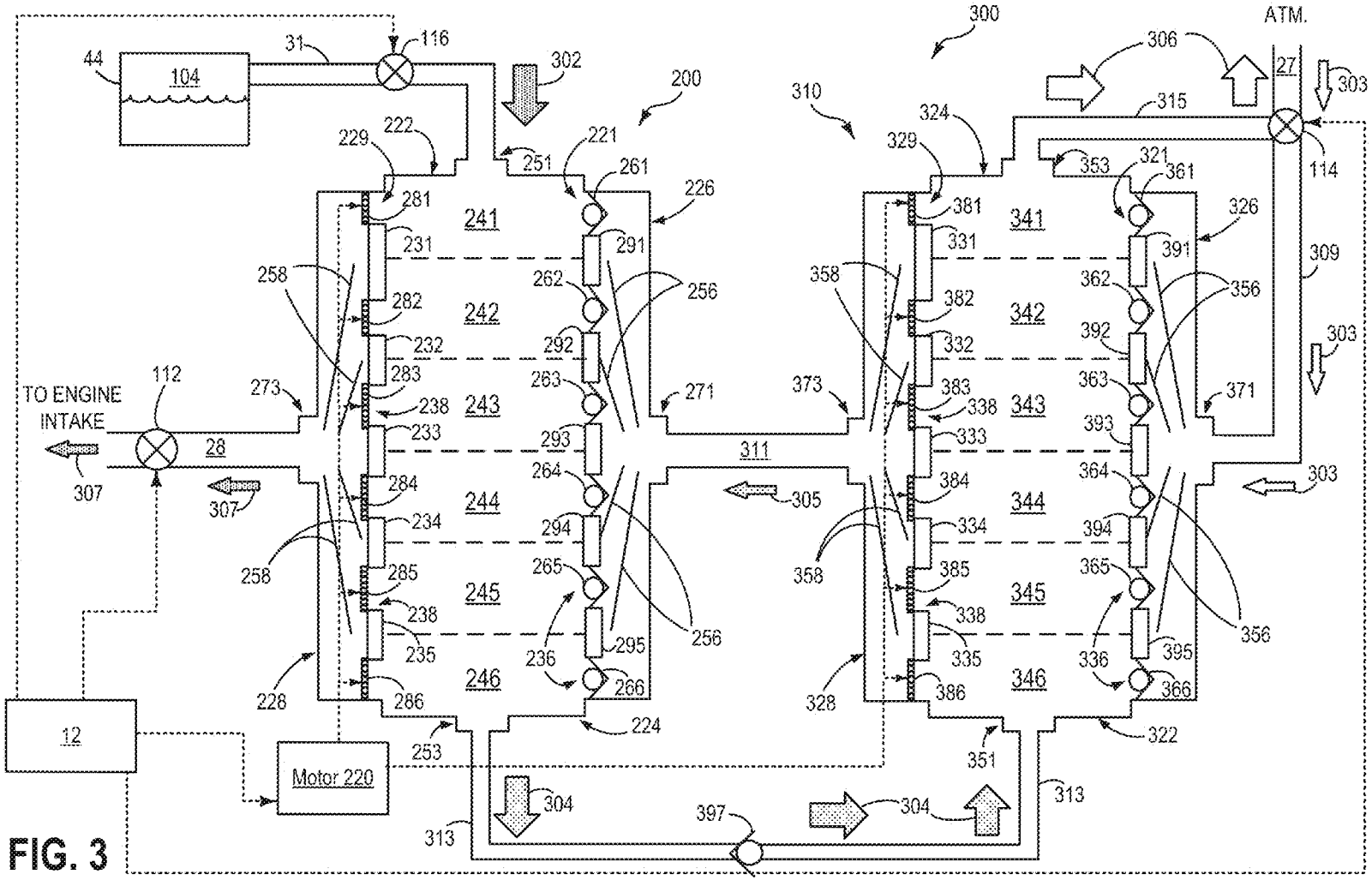
FIGS. 3-5 schematically portray example embodiments of a pair of fuel vapor canisters coupled to each other in the fuel system of FIG. 1.

Now turning to FIG. 3, an alternate embodiment 300 is shown featuring an arrangement of two fuel vapor canisters. In the depicted embodiment, each of the two canisters may be similar to canister 200 of FIG. 2. As such, engine system components introduced in FIG. 1 and canister components introduced in FIG. 2 are numbered similarly in FIG. 3 and not reintroduced.

Canister system 300 (also termed, fuel vapor storage system 300) includes canister 200 of FIG. 2 and canister 310 fluidically coupled to each other. It will be appreciated that canister 310 may be constructed in a similar manner to canister 200. Canister 310 may include adsorptive material surrounded by a first side 322, a second side 324, a first edge 321, and a second edge 329. A first input 351 arranged on first side 322 of canister 310 may be fluidically coupled to first output 253 on second side 224 of canister 200 via conduit 313. Check valve 397 in conduit 313 may permit flow of fuel vapors in only one direction: from canister 200 to canister 310. A reverse flow of vapors, as in from canister 310 to canister 200, may be prevented by check valve 397.

Canister 310 also includes a first output 353 arranged on second side 324 of canister 310. Similar to canister 200, first output 353 may be positioned directly across from first input 351 and a full length of canister 310 may be included therebetween. In other words, the entire length of canister 310 may be encompassed between first input 351 on first side 322 and first output 353 on second side 324 of canister 310.

First output 353 may be fluidically coupled to CVV 114 via conduit 315 and may also communicate with the atmosphere via vent line 27 when CVV 114 is actuated to a first position, e.g. during refueling conditions. CVV 114 may be switched to a second position to block communication between first output 253 of canister 310 with the atmosphere. Further, in the second position, CVV 114 may fluidically couple second input 371 to the atmosphere via conduit 309 and vent line 27. Second input 371 is shown positioned along third side 326 of canister 310. Second output 373 of canister 310 is located on fourth side 328, and second output 373 is positioned directly across from and opposite second input 371. A full width of canister 310 may be included between second input 371 and second output 373. In other words, the full width of canister 310 may be encompassed between third side 326 and fourth side 328 of canister 310.

Similar to canister 200, a plurality of regions may be present within adsorptive material such as regions 341, 342, 343, 344, 345, and 346. These regions may be physically contiguous and the dotted lines depicting a separation between these regions are merely for reference. Each of the regions is flanked on the first edge 321 by a check valve and is lined on the second edge 329 by a sliding door (or shutter). The first and second edges may also include blocks to obstruct the flow of air and fuel vapors such that air and fuel vapors may only flow into the adsorptive material through the check valves and exit the adsorbent past the sliding doors.

More specifically, adsorptive regions 341, 342, 343, 344, 345, and 346 are shown bordered on first edge 321 by respective check valves 361, 362, 363, 354, 365, and 366, and lined on second edge 329 by respective sliding doors 381, 382, 383, 384, 385, and 386. The plurality of check valves on first edge 321 may control air flow at a first plurality of openings 336 while the plurality of sliding doors on second edge 329 may control flow of air and fuel vapors through a second plurality of openings 338.

Air flow into the adsorbent in regions 341, 342, 343, 344, 345, and 346 may be prevented by blocks 391, 392, 393, 394, and 395 along first edge 321, and air flow out of adsorptive material may be impeded on second edge 329 by blocks 331, 332, 333, 334, and 335. Further, as will be observed in canister 310 (similar to canister 200), each block may adjoin two openings and respective check valves or sliding doors. For example, block 391 is shown bordering check valves 361 and 362. Similarly, block 333 is coupled to sliding door 384 and sliding door 383. Thus, air (and fuel purge) flow into the adsorptive material may solely occur through the plurality of check valves. Further, air flow (and vapor purge flow) out of the adsorbent may be permitted solely past the plurality of sliding doors.

Canister system 300 of FIG. 3 includes canisters 200 and 310 fluidically coupled to each other at different ports. As described earlier, first output 253 of canister 200 may fluidically communicate with first input 351 of canister 310 via conduit 313. Further, second output 373 of canister 310 may be fluidically coupled to second input 271 of canister 200 via conduit 311. As in FIG. 2, second output 273 of canister 200 may fluidically communicate with intake passage 42 via purge line 28 and CPV 112. First input 251 of canister 200 may fluidically communicate with fuel tank 44 via FTIV 116 and first output 353 of canister 310 may fluidically communicate with the atmosphere via CVV 114. It will be appreciated that canister 200 may be fluidically coupled to the atmosphere solely through canister 310. Therefore, canister 200 may not be directly coupled to the atmosphere. Further, canister 310 may fluidically communicate with the engine intake and the fuel tank 44 solely through canister 200. Thus, canister 310 may not be directly coupled to either the engine intake or the fuel tank.

Canisters 200 and 310 may be serially coupled for each of a storage flow and a purge flow via different ports. A refueling method and a fuel purging method will now be discussed in further detail below.

As described in reference to FIG. 2, canister 200 has a first input (or tank port) 251 that is fluidly coupled with fuel tank 44 via conduit 31. The tank port 251 is a canister inlet that permits fuel vapors that escape from the fuel tank to enter canister 200 and canister 310 for storage when fuel tank isolation valve (FTIV) 116 is opened. Both canister 200 and canister 310 may be filled with an adsorbent such as activated charcoal to store the received fuel vapors.

During a fuel tank refueling operation and with the engine not running (e.g., an engine off and/or vehicle key-off condition), embodiment 300 including canisters 200 and 310 may be operated in the fuel vapor storage mode. During this mode, FTIV 116 may be opened by controller 12 while CPV 112 is maintained closed and CVV 114 is adjusted to the first position fluidically coupling first output 353 of canister 310 to the atmosphere via conduit 315 and vent line 27. By opening FTIV 116, refueling vapors generated in fuel tank 44 during the refueling operation can be received in canister 200 via tank port 251. By adjusting CVV 114 to the first position, refueling fuel tank vapors entering first input 251 of canister 200 can be vented to the atmosphere only after flowing through the greatest length of adsorbent within each of canister 200 and canister 310. This increases the duration spent by fuel vapors within the canisters and enhances adsorption efficiency. At the same time, by closing CPV 112, fuel tank vapors are not leaked from the canisters to the engine intake. After a refueling operation is completed, FTIV 116 may be closed.

The refueling flow in the embodiment of FIG. 3 may be described further as below. Fuel vapors exiting fuel tank 44 may first enter canister 200 via first input 251 along with a small proportion of air from vapor space 104. The mixture of air and fuel vapors entering first input 251 is shown as arrow 302. As the fuel vapors traverse the entire length of canister 200 from first input 251 to first output 253, a proportion of these fuel vapor may be adsorbed within adsorptive material in canister 200.

Remnant fuel vapors (depicted as arrow 304) that were not adsorbed in canister 200 may exit canister 200 via first output 253, flow through conduit 313, past check valve 397, and enter canister 310 via its first input 351. These fuel vapors 304 may flow through the full length of canister 310 from first input 351 to first output 353 on the first opposite side to first input 351, thus allowing greater adsorption. The mixture of air and fuel vapors (arrows 306) exiting canister 310 at first output 353 may comprise largely air with traces of fuel vapor. In another example, the canister system may completely adsorb all fuel vapors and primarily air may exit canister 310 as 306. Air, possibly with traces of fuel, may be released into the atmosphere via vent line 27 by maintaining CVV 114 in its first position.

During a purge operation, fuel vapors stored in canister system 300 may be expelled into the engine intake for combustion. Once purging conditions are determined, controller 12 may close FTIV 116, open CPV 112 and switch CVV 114 to the second position. By placing CVV 114 in its second position, the second input 371 of canister 310 may fluidically communicate with the atmosphere while first output 353 of canister 310 may be blocked from communication with the atmosphere. Further, controller 12 may communicate with motor 220 to actuate sliding doors in both canisters (200 and 310) to their open positions such that second plurality of openings in each canister (238 and 338) may be unobstructed.

Intake vacuum may be applied to canister system 300 so that atmospheric air is drawn into the system via CVV 114 and conduit 309. Fresh air, depicted as arrows 303, may enter canister 310 at second input 371. Herein, air may be simultaneously guided via baffles 356 through the plurality of check valves (361-366) into corresponding regions within adsorptive material, e.g. regions 341-346. Air 303 enables purging of stored fuel vapors within the adsorptive material and a mixture of air and fuel vapors may exit regions 341-346 concurrently past respective sliding doors 381-386. While a larger portion of air may stream through the shorter direct width of adsorptive material, a smaller proportion of air may flow through a longer distance of the adsorbent desorbing fuel vapors. For example, air may flow through check valve 363, across region 343, and past sliding door 383 to traverse a shorter width. A smaller proportion of air may flow through check valve 363, stream diagonally over a relatively longer distance through regions 343 and 344, and exit past sliding door 385.

A mixture of air and desorbed fuel vapors 305 may exit adsorptive material in canister 310 from second edge 329, via sliding doors 381-386. Further, the mixture 305 may be guided by baffles 358 towards second output 373, and thereon, into conduit 311. Therefore, the mixture of air and desorbed fuel vapors may exit canister 310 out of second output 373, and enter canister 200 via second input 271 of canister 200. Herein, the mixture 305 may be directed towards check valves 261-266 via baffles 256. Mixture 305 may enter regions 241-246 of adsorptive material within canister 200 at the same time through plurality of check valves 261-266. Stored vapors within regions 241-246 may be desorbed by mixture 305 and the combined mix of air and fuel vapors (arrow 307) may exit adsorptive material simultaneously past sliding doors 281-286. The mixture, as indicated by arrow 307, now comprising a larger proportion of fuel vapors, may be streamed by baffles 258 towards second output 273 of canister 200. Upon exiting canister 200, the mixture may flow into purge line 28, through CPV 112 into the engine intake.

In this way, by flowing fuel tank vapors serially through an extensive length of two fuel vapor canisters, a greater proportion of fuel vapors may be adsorbed reducing bleed emissions. Further, by purging stored fuel vapors across the widths of the two canisters in a serial manner, the adsorbed vapors may be purged within a shorter duration. It will be appreciated that the canisters described in the present disclosure feature a width that is shorter than a length that tank vapors traverse for adsorption enabling a shorter, more complete purge.

Thus, the embodiment of canister system 300 includes a first canister and a second canister, the first canister fluidically coupled to the fuel tank via a fuel tank isolation valve (FTIV) and further coupled to the air intake passage via a canister purge valve, the second canister fluidically coupled to a canister vent valve and also coupled fluidically to the first canister at a first opening (for storage flow) and a second opening (for purge flow), the first canister including a first adsorptive material and the second canister including a second adsorptive material, each adsorptive material configured to store fuel vapors generated in the fuel tank, each of the adsorptive materials flanked on a first edge by a plurality of check valves and lined on a second edge by a plurality of sliding doors. Specifically, the first adsorptive material may be flanked on the first edge by a plurality of check valves and lined on the second edge by a plurality of sliding doors. Similarly, the second adsorptive material within the second canister may be flanked on its first edge by a plurality of check valves and lined on its second edge by a plurality of sliding doors.

Figure 4:
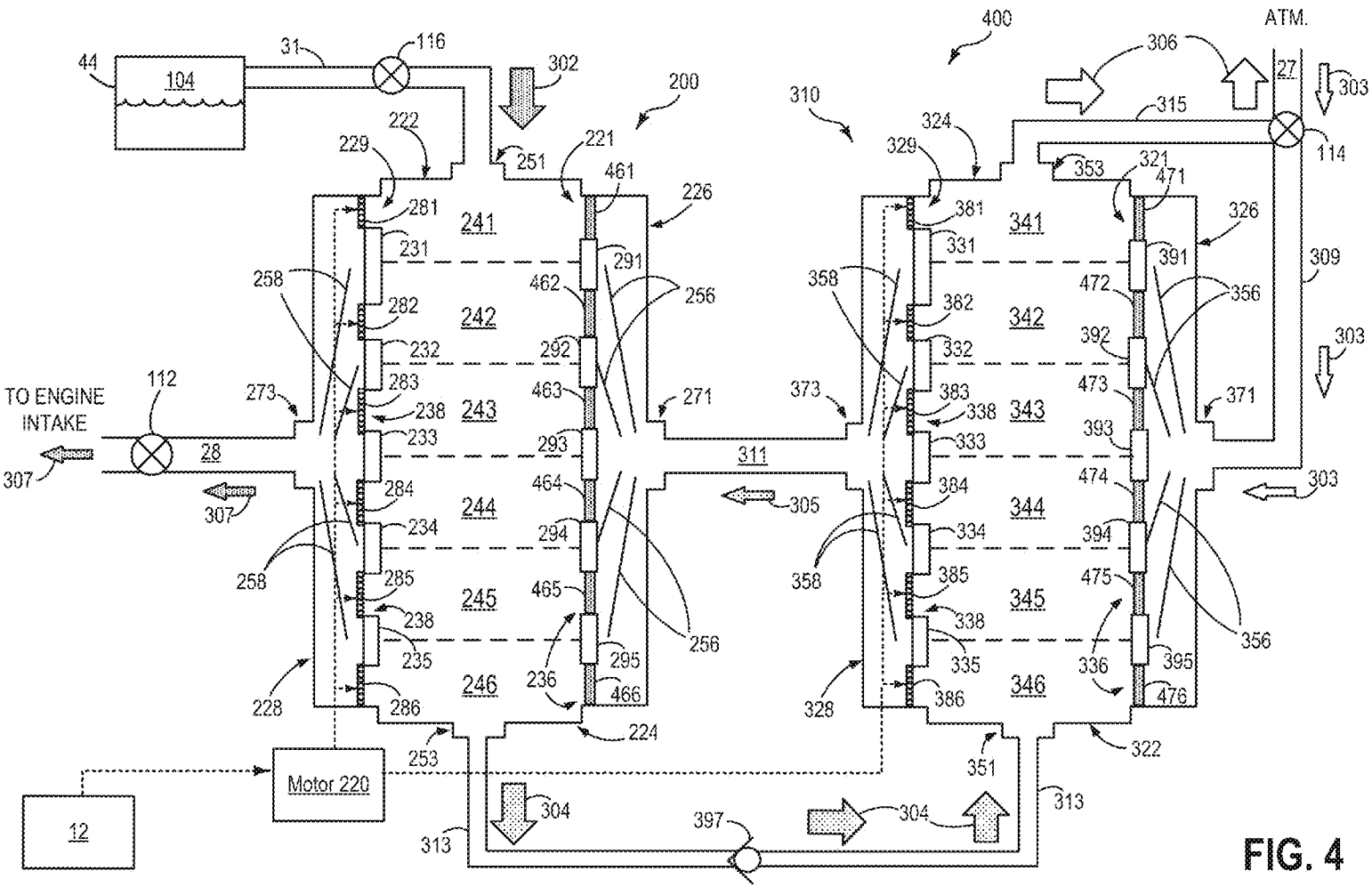

Turning now to FIG. 4, an alternate embodiment of canister system 300 is depicted. Herein, the plurality of check valves 261-266 and 361-366 are substituted by a plurality of polymer membranes which allow fluid flow in response to a pressure differential across the polymer membranes. Previously introduced canister components are similarly numbered in FIG. 4. Some components and communication signals (e.g. controller to FTIV 116) included in FIGS. 2 and 3 may not be shown in FIG. 4 for improving visual clarity in the figure.

As shown in FIG. 4, canister 200 includes polymer membranes 461, 462, 463, 464, 465, and 466 controlling the plurality of openings 236 along first edge 221. Canister 310 includes polymer membranes 471, 472, 473, 474, 475, and 476 regulating plurality of openings 336 along first edge 321 of adsorptive material. During purge operation, air drawn in from the atmosphere via CVV 114 may enter canister 310 via second input 371. The air may be guided by baffles 356 towards polymer membranes 471-476. In response to this air flow, pressure on a first surface of each of the plurality of polymer membranes may increase. The first surface of each of the plurality of polymer membranes includes a surface closest to second input 371. Based on the sensed pressure differential across the polymer membrane, each polymer membrane may open allowing flow of air therethrough into corresponding adsorbent regions 341-346.

The mixture of air and desorbed fuel vapors 305 may exit canister 310 and enter canister 200 via second input 271 of canister 200. The mixture 305 may be directed towards polymer membranes 461-466 by baffles 256. Further, each polymer membrane may open based on a pressure differential sensed across the polymer membrane. As the mixture flows through regions 241-246 within adsorptive material within canister 200, additional stored fuel vapors may be desorbed to form mixture 307 which exits the adsorbent simultaneously past sliding doors 281-286, out of second output 273 and into engine intake via purge line 28.

In this manner, polymer membranes may function similar to check valves allowing fluid flow in one direction. Since the polymer membranes allow fluid flow based on a pressure differential, fluid flow may only occur during a purge operation due to the application of manifold vacuum. During storage flow, polymer membranes may hinder the flow of fuel vapors across conduit 311. The polymer membranes may be formed of any suitable material that is responsive to pressure differences and that can withstand operating conditions. Further, the polymer membranes may include one or more apertures that allow fluid flow under certain conditions, e.g. pressure exceeding a certain amount.

Figure 5:
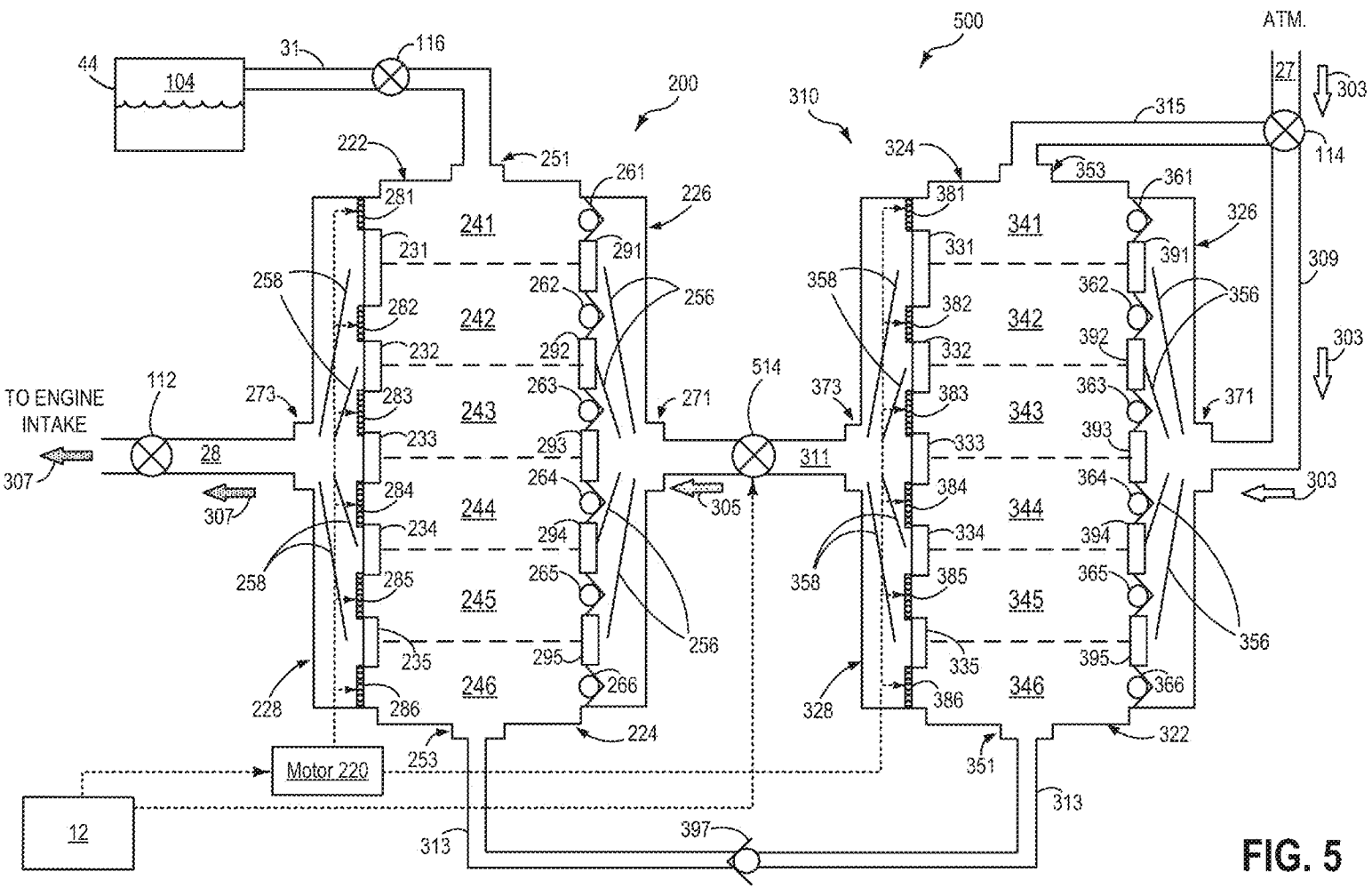

FIG. 5 shows a further embodiment 500 for the canister system of FIG. 3. As such, previously introduced canister components are similarly numbered in FIG. 5. Some components and communication signals (e.g. controller to FTIV 116) included in FIGS. 2 and 3 may not be shown in FIG. 5 for enabling a clearer depiction in the figure.

In the depicted embodiment 500, conduit 311 which fluidically couples second output 373 of canister 310 to second input 271 of canister 200 includes a solenoid valve 514. In particular, controller 12 may actuate solenoid valve 514 to open or close during a purge cycle based on canister load. Solenoid valve 514 may regulate flow of the air-fuel mixture from canister 310 to canister 200. For example, if it is determined that canister 200 has a greater load of stored fuel vapors, solenoid valve 514 may regulate the flow of air-fuel mixture from canister 310 to allow a longer purge of canister 200.

The canister system of FIGS. 3-5 may be operated by controller 12 in a plurality of modes by selective adjustment of the various valves. For example, the fuel system may be operated in a fuel vapor storage mode to direct refueling vapors or diurnal vapors into the canister system while preventing fuel vapors from being directed into the intake manifold. An example embodiment 600 of the canister system of FIG. 3 being operated in the fuel vapor storage mode is now shown and described with reference to FIG. 6. Embodiment 600 may include a canister system, similar to canister system 300. Various components and labels/numbers shown in FIG. 3 have been removed in FIG. 6 to enable a clearer depiction of fuel vapor storage flow.

During a fuel tank refueling operation and with the engine in a shutdown state (e.g., an engine off and/or vehicle key-off condition), canister system 300 may be operated in the fuel vapor storage mode. As described earlier, FTIV 116 may be opened by controller 12 (not shown in FIG. 6) while canister purge valve (CPV) 112 is maintained closed. The opened FTIV 116 is completely white to indicate an open position while CPV 112 is shown closed by a greyed out valve in FIG. 6. Further, canister vent valve (CVV) 114 may be switched to its first position allowing a fluidic coupling between first output 353 of canister 310 and the atmosphere. As mentioned earlier, the first position of CVV 114 obstructs fluidic communication between the atmosphere and second input 371 of canister 310. The first position of CVV 114 is depicted in FIG. 6 by greying out a communication between second input 371 and CVV 114. Thus, CVV 114 is partially greyed out. Further, the portions that are white indicate fluidic communication between conduit 315 and vent line 27.

As FTIV 116 is opened, refueling vapors present in vapor space 104 of fuel tank 44 may flow into canister 200 via first input 251 as shown by arrow 302. Arrow 302 may include a smaller proportion of air. Upon entering canister 200, fuel vapors (and some air) may only exit canister 200 via first output 253 at the first opposite side 224. Consequently, fuel vapors may stream through the entire length of adsorptive material within (e.g., regions 241-246) as shown by arrow 602. While arrow 602 depicts a straight-line flow, fuel vapors may also follow other paths from first input 251 to first output 253. Therefore, fuel vapors may flow through at least a length L1 of canister 200 as shown by arrow 602.

Fuel vapors that have not been adsorbed in canister 200 along with the smaller proportion of air (as indicated by arrow 304) may exit canister 200 via first output 253, and thereon flow through conduit 313, past check valve 397, and into the first output 351 of canister 310. Similar to canister 200, fuel vapors may exit canister 310 into atmosphere only via first output 353 of canister 310. Therefore, the fuel vapors (with the smaller proportion of air) may traverse the full length of canister 310 through the adsorptive material within, as shown by arrow 604, from first input 351 to first output 353. While arrow 604 depicts a straight-line flow, fuel vapors may also follow other longer paths towards first output 353. Accordingly, fuel vapors may flow through at least a length L2 of canister 310 enabling improved adsorption of fuel vapors by extending length of adsorptive flow. A mixture of air and fuel vapor traces may exit canister 310 via conduit 315, past CVV 114, and through vent line 27 into the atmosphere. The mixture, as shown by arrow 306, may comprise the smaller proportion of air with traces of fuel vapors. After a refueling operation is completed, FTIV 116 may be closed.

During engine operation, when purging conditions are not met, FTIV 116 may remain closed while CVV 114 and CPV 112 are also maintained closed. During such conditions, diurnal or "running loss" fuel vapors may be generated in fuel tank 44. These diurnal vapors may be received in canisters 200 and 310 along the same path as refueling vapors described earlier for storage by intermittently opening FTIV 116. For example, the isolation valve may be opened intermittently in response to the fuel tank pressure becoming elevated (due to the generation of diurnal fuel vapors). As with the refueling vapors, the diurnal fuel tank vapors entering first input 251 of canister 200 and first input 351 of canister 310 can be vented to the atmosphere only after flowing through the entire lengths of canister adsorbent (e.g., carbon) in each canister and may exit the canister system via conduit 315 coupled to first output 353 of canister 310 (as shown by arrow 306).

As yet another example, the canister system 300 may be operated in a canister purging mode. An example embodiment 700 of the canister of FIG. 3 being operated in the canister purging mode is now shown and described with reference to FIG. 7. Various components and labels/numbers shown in FIG. 3 have been removed in FIG. 7 to enable a clearer depiction of fuel vapor purge flow.

After an emission control device light-off temperature has been attained and with the engine running, canister system 300 may be operated in the purging mode when canister load(s) is (are) sufficiently high. During this mode, FTIV 116 may be closed by controller 12 while CPV 112 is opened. Further, CVV 114 may be switched to its second position wherein a fluidic communication is enabled between the atmosphere and second input 371 of canister 310. Further still, the sliding doors in each canister may be actuated to permit fluid flow therethrough. By closing FTIV 116, fuel tank vapors may not be drawn into the engine intake manifold during purging (the closed position of FTIV 116 is indicated by the greyed out valve). By adjusting CVV 114 to its second position, the second input 371 of canister 310 is able to receive atmospheric air from vent line 27 via conduit 309 to desorb stored fuel vapors from the canister system. Further, in its second position, CVV 114 blocks fluidic communication between first output 353 of canister 310 and the atmosphere. The second position of CVV 114 is indicated by greying out the access from conduit 315 coupled to first output 353 and showing the allowed fluidic communication between second input 371 in white (within CVV 114).

Thus, air (depicted as arrow 303) flows through conduit 309 into second input 371 of canister 310. After being guided towards check valves 361-366 by baffles 356, air 303 may stream through the adsorptive material (e.g. regions 341-346) desorbing stored fuel vapors. The air may purge the stored vapors across an entire width W2 of the adsorptive material as shown by arrows 703. The shortest purge span through the adsorptive material is depicted by arrows 703, but other paths of relatively longer distance may be followed by fuel vapors (and air) during purging operation.

A mixture of air and desorbed vapors may exit the adsorbent past the plurality of sliding doors (381-386) guided by baffles 358 to second output 373 of canister 310. The mixture represented by arrow 305 may flow through conduit 311 into second input 271 of canister 200. Hereon, the mixture may be directed by baffles 256 towards the plurality of check valves 261-266 and through adsorbent regions (e.g. 241-246). Fuel vapors stored with adsorbent regions may be desorbed and purge flow may occur across the entire width W1 of the adsorbent as shown by arrows 705. Alternate routes, other than that shown by arrows 705, along the width of the adsorbent may also be followed. After flowing through the adsorptive material, the mixture of fuel vapors and air may stream past sliding doors 281-286 and may be guided towards second output 273 of canister 200 by baffles 258. The mixture, indicated by arrow 307, may comprise a larger proportion of fuel vapors than the mixture exiting canister 310 as arrow 305. The total purge flow from both canisters (indicated by arrow 307) may stream towards the engine intake via purge line 28 past CPV 112.

During the purging, the opening of CPV 112 may be adjusted by controller 12 based on a desired purge flow rate. Thus, as the purge flow rate increases, the opening of CPV 112 may be increased.

Purge line 28 may be coupled to intake passage 42, downstream of intake throttle or throttle 64. Thus, upon receiving the mixture of desorbed fuel vapors and air into the intake passage, controller 12 may adjust an air/fuel ratio based on the amount of purge vapors received.

During the purging mode, the purged fuel vapors from the canisters are combusted in the engine. The purging may be continued until the stored fuel vapor amount in the canister is below a threshold. After a purging operation is completed, CPV 112 may be closed, and CVV 114 may be switched to its first position while maintaining FTIV 116 in its closed position. Alternatively, CVV 114 may be switched to a fully closed position wherein neither the second input 371 nor first output 353 are fluidically coupled to the vent line 27.

Figure 8:
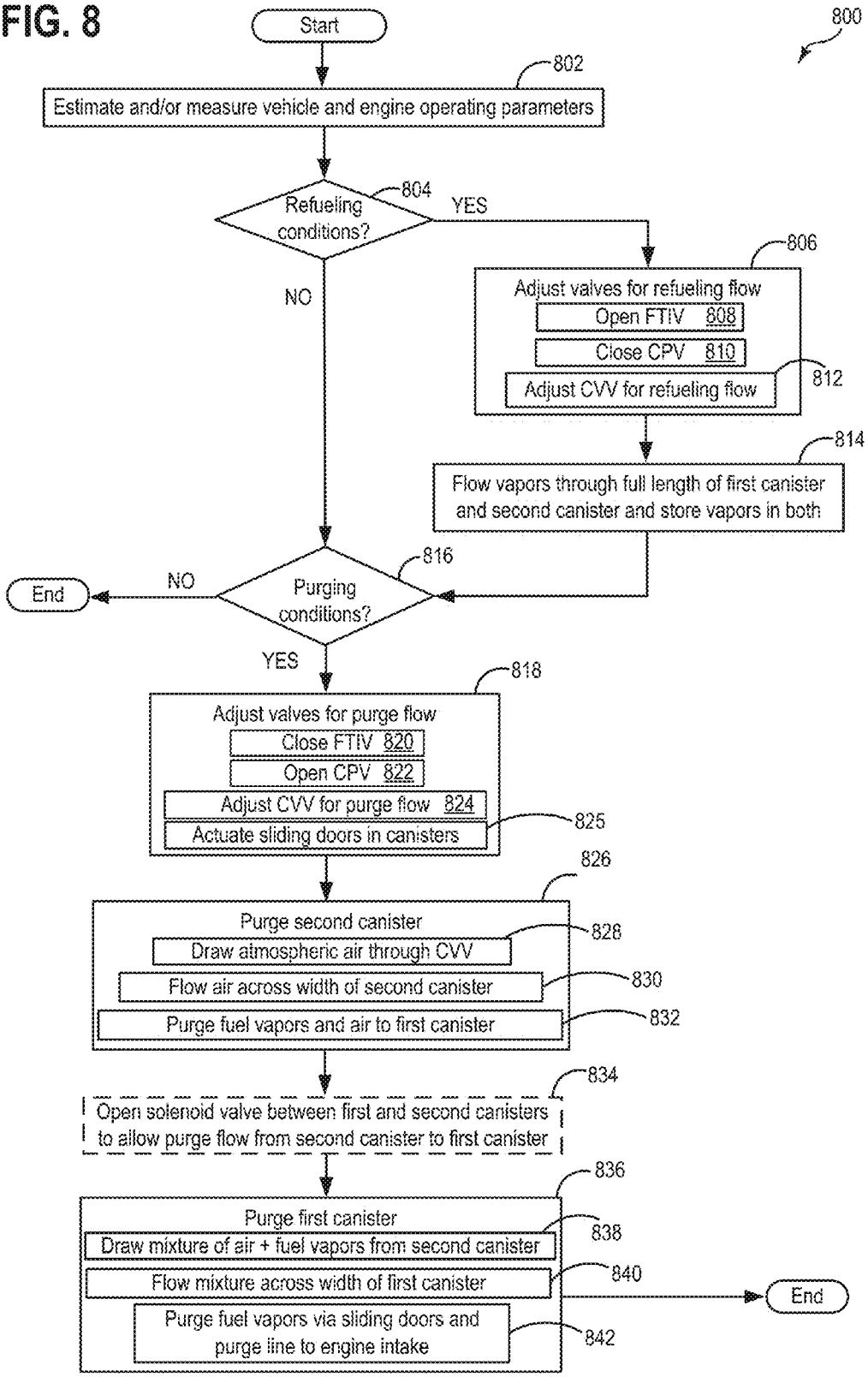
FIG. 8 shows an example of a method for controlling the fuel system canisters of FIGS. 3-5.

Now turning to FIG. 8, an example method 800 is shown for operating the fuel vapor canister system of FIGS. 3-5. The method enables increased adsorption of refueling vapors by flowing fuel vapors through a full length of each of the canisters in the canister system. Further, a faster purge may be enabled by flowing air for desorption of fuel vapors across a shorter width of each canister in the canister system.

At 802, the method includes estimating and/or measuring vehicle and engine operating parameters. These may include, for example, engine speed, vehicle speed, driver torque demand, barometric pressure (BP), MAP, MAF, engine temperature, catalyst temperature, battery state of charge, ambient conditions (temperature, humidity), etc.

At 804, it may be determined if refueling conditions have been met. In one example, refueling conditions may be considered met if a fuel tank fuel level is less than a threshold, a canister hydrocarbon load is less than a threshold, and a fuel tank is being refilled with the engine in a shutdown, non-operational mode. If refueling conditions are not met, routine 800 may progress to 816. Else, if refueling conditions are met, at 806, the routine includes adjusting various valves for refueling or storage flow. At 808, a fuel tank isolation valve (FTIV) may be opened to allow fuel tank refueling vapors to be directed into the fuel vapor canister system for storage. In addition, at 810, a canister purge valve (CPV) coupled to canister system may be closed. In doing so, the intake manifold may be isolated from the refueling vapors. At 812, a canister vent valve (CVV) may be moved to a first position for refueling flow. Herein, the CVV adjustment allows fluidic communication between a second canister and the atmosphere for a refueling flow. In the example of canister system 300, adjusting the CVV to its first position enables fluidic communication between first output 353 of canister 310 through vent line 27 with the atmosphere. The valves may be maintained in their position until the refueling is completed at which time the FTIV may also be closed. Next at 814, fuel vapors from the fuel tank may flow through the full length of a first canister (canister 200 of canister system 300) and thereon, through the full length of the second canister (canister 310 of canister system 300) for adsorption and storage within the canisters.

At 816, after refueling is completed, or if refueling conditions are not met (at 804), it may be determined if purging conditions have been met. In one example, purging conditions may be considered met in response to canister hydrocarbon load being higher than a threshold load. In another example, purging conditions may be considered met if a threshold duration of vehicle (or engine) operation has elapsed since a last purging operation. Further still, purging conditions may be considered met if a threshold distance of vehicle (or engine) operation has elapsed since a last purging operation. If purging conditions are not met, the routine may end.

If purging conditions are met, then at 818, the routine includes adjusting positions of various valves for purge flow. At 820, the routine includes closing the FTIV to isolate the fuel tank from the canister. In addition, the CPV may be opened at 822. Further, the CVV may be adjusted at 824 to a second position that fluidically couples the second canister to the atmosphere for a purge flow. In the example of canister system 300, the second position of CVV 114 may allow fluidic communication between second input 371 of canister 310 to the vent line 27 and the atmosphere. By adjusting the CVV to its second position, atmospheric air may be received in the canister system via the second input 371 of canister 310, and the air may be used to desorb and purge the stored fuel vapors in each canister. Further, at 825, sliding doors lining adsorptive material within each of the two canisters may be actuated open for the purge operation.

At 826, the second canister may be purged. Atmospheric air may be drawn through the CVV into the second canister at 828. In the example of canister system 300, air may be drawn in through second input 371. At 830, the air may be streamed across the width of the second canister. For example, air may enter the adsorptive material within the canister through a plurality of openings controlled by a plurality of check valves. At 832, the air may purge stored fuel vapors from the adsorptive material in the second canister past a plurality of sliding doors into the first canister.

At 834, in the embodiment of FIG. 5, an optional solenoid valve coupled in a conduit between the second canister and the first canister may be opened. For example, solenoid valve 514 coupled in conduit 311 between canister 310 and canister 200 may be opened. Opening the solenoid valve may permit the flow of a mixture of air and fuel vapors from the second canister into the first canister for purging stored vapors in the first canister.

Next, at 836, the first canister may be purged. At 838, the mixture of air and fuel vapors from the second canister may enter the first canister. This mixture may flow across the entire width of the first canister. The mixture may enter the adsorptive material within the first canister by flowing through a plurality of openings controlled by a plurality of check valves. Adsorbed vapors may be desorbed and the mixture may exit the adsorptive material in the first canister past a plurality of sliding doors that are opened during purge flow. At this point, the mixture may comprise a larger proportion of desorbed fuel vapors than the mixture exiting the second canister. The mixture may flow from the canister system into an engine intake at a location downstream of the intake throttle.

In this way, a fuel vapor canister system may be purged in a shorter duration. By purging stored fuel vapors across a width of each canister, the width being significantly shorter than a length of each canister, a faster purge may be ensured. Further, during a storage flow, the fuel vapors may be streamed over the length of each canister enabling increased adsorption of a larger proportion of fuel vapors. Bleed emissions may be, thus, captured within the canister system more efficiently. By improving the likelihood that a greater proportion of emitted fuel vapors are stored and by allowing a faster and more completed purge, vehicle emissions compliance can be improved.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

flowing fuel vapors from a fuel tank through a full length of a fuel vapor canister from a first input to a first output on a first opposite side from the first input; and purging the fuel vapors from the fuel vapor canister through a full width in the fuel vapor canister from a second input to a second output on a second opposite side from the second input.

2. The method of claim 1, wherein the first input and the first output are positioned directly across from each other, the first output being arranged on the first opposite side, and wherein the first input and the first output include the full length therebetween.

3. The method of claim 1, wherein the second input and the second output are arranged directly across from each other, the second output being positioned on the second opposite side and wherein the second input and the second output include the full width therebetween.

4. The method of claim 1, wherein the purging of the fuel vapors occurs in a substantially perpendicular direction relative to the flowing of fuel vapors from the fuel tank through the full length of the fuel vapor canister.

5. The method of claim 1, wherein the full width of the fuel vapor canister is shorter than the full length of the fuel vapor canister.

6. The method of claim 1, wherein purging the fuel vapors includes flowing air simultaneously through a plurality of check valves into an adsorptive material arranged within the fuel vapor canister, the air purging the fuel vapors stored in the adsorptive material, and the air and fuel vapors exiting the adsorptive material past multiple sliding doors simultaneously.

7. The method of claim 6, wherein the multiple sliding doors are positioned opposite to the plurality of check valves, and wherein flowing air through the plurality of check valves includes flowing air in a direction substantially parallel to the width of the canister.

8. The method of claim 7, wherein the check valves comprise a polymer membrane, and wherein the polymer membrane opens in response to a pressure differential across the polymer membrane.

9. The method of claim 1, further comprising purging the fuel vapors from the fuel vapor canister to an engine intake downstream of an intake throttle.

10. The method of claim 9, further comprising adjusting an air-fuel ratio responsive to the purging of fuel vapors into the engine intake.

11. A method, comprising:

directing an adsorptive flow of fuel vapors from a fuel tank through a length of a fuel vapor canister from a first side to a second, opposite, side of the fuel vapor canister; and directing a purge flow of fuel vapors from the fuel vapor canister to an engine intake across a width in the fuel vapor canister from a third side to a fourth side of the fuel vapor canister.

12. The method of claim 11, wherein the first side and the second side of the fuel vapor canister are located opposite each other, and wherein the third side and the fourth side of the fuel vapor canister are positioned opposite each other, each of the first, the second, the third, and the fourth sides distinct from one another and mutually exclusive of each other.

13. The method of claim 11, wherein a length of adsorptive flow through the length of the fuel vapor canister is greater than a length of the purge flow across the width of the fuel vapor canister.

14. The method of claim 11, wherein the adsorptive flow is substantially perpendicular to the purge flow.

15. The method of claim 11, wherein directing the purge flow includes flowing air concurrently through a plurality of openings controlled by a plurality of check valves into an adsorptive material within the fuel vapor canister, each opening controlled by a respective check valve.

16. The method of claim 15, wherein the purge flow exits the adsorptive material via a plurality of sliding doors, the plurality of sliding doors positioned directly across from the plurality of check valves.

17. A vehicle system, comprising:

an engine including an intake manifold;

an intake passage for delivering intake air to the intake manifold;

a fuel tank configured to provide fuel to an engine cylinder;

a fuel vapor storage system including a first canister and a second canister, the first canister fluidically coupled to the fuel tank via a fuel tank isolation valve (FTIV) and further coupled to the air intake passage via a canister purge valve, the second canister fluidically coupled to a canister vent valve and also coupled fluidically to the first canister at a first opening and a second opening, the first canister including a first adsorptive material and the second canister including a second adsorptive material, each adsorptive material configured to store fuel vapors generated in the fuel tank, each adsorptive material flanked on a first edge by a plurality of check valves and lined on a second edge by a plurality of sliding doors; and a controller with computer-readable instructions stored in non-transitory memory for:

during a refueling condition, opening the FTIV;

flowing fuel vapors from the fuel tank through a full length of the first adsorptive material in the first canister; and directing remnant fuel vapors from the first canister via the first opening through a full length of the second adsorptive material within the second canister; and during purge conditions, opening the canister purge valve and the canister vent valve;

drawing air through the second adsorptive material of the second canister;

purging fuel vapors through an entire width of the second adsorptive material of the second canister into the first canister along with the air via the second opening;

flowing a mixture of the air and the fuel vapors from the second canister into the first adsorptive material of the first canister via the second opening; and purging fuel vapors stored in the first adsorptive material along with the mixture of the air and the fuel vapors from the second canister across an entire width of the first adsorptive material into the intake passage.

18. The vehicle system of claim 17, wherein drawing air through the second adsorptive material includes drawing air through the plurality of check valves on the first edge of the second adsorptive material, and wherein purging fuel vapors stored in the second adsorptive material includes purging past the plurality of sliding doors on the second edge of the second adsorptive material, the first and the second edges being opposite of each other.

19. The vehicle system of claim 18, wherein flowing the mixture of the air and the fuel vapors from the second canister into the first adsorptive material of the first canister includes flowing the mixture through the plurality of check valves on the first edge of the first adsorptive material, and wherein purging fuel vapors stored in the first adsorptive material along with the mixture of the air and the fuel vapors from the second canister includes purging past the plurality of sliding doors on the second edge of the first adsorptive material, the first and the second edges being opposite of each other.

* * * * *